US009897967B2

(12) United States Patent
Koyama et al.

(10) Patent No.: US 9,897,967 B2
(45) Date of Patent: Feb. 20, 2018

(54) CLEANING UNIT AND IMAGE FORMING APPARATUS

(71) Applicant: CANON KABUSHIKI KAISHA, Tokyo (JP)

(72) Inventors: Hiroshi Koyama, Matsudo (JP); Yuuichi Tanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/232,017

(22) Filed: Aug. 9, 2016

(65) Prior Publication Data

US 2017/0060073 A1 Mar. 2, 2017

(30) Foreign Application Priority Data

Aug. 25, 2015 (JP) ..... 2015-165594

(51) Int. Cl.
*G03G 21/10* (2006.01)

(52) U.S. Cl.
CPC ... *G03G 21/105* (2013.01); *G03G 2215/0827* (2013.01)

(58) Field of Classification Search
CPC ..... G03G 21/105; G03G 15/0891; G03G 2215/0827
See application file for complete search history.

(56) References Cited

U.S. PATENT DOCUMENTS

2007/0019985 A1* 1/2007 Kim ..... G03G 21/12 399/111
2011/0305486 A1* 12/2011 Ohgoshi ..... G03G 15/0877 399/263
2012/0114386 A1* 5/2012 Takashima ..... G03G 15/0879 399/258
2015/0098827 A1* 4/2015 Reidhaar ..... F16D 1/108 416/176
2015/0268585 A1* 9/2015 Kadowaki ..... G03G 21/105 399/358

FOREIGN PATENT DOCUMENTS

JP S51-147445 U 11/1976
JP H01-108555 U 7/1989
JP H04-340991 A 11/1992
JP 2004-020572 A 1/2004
JP 2006-139084 A 6/2006

* cited by examiner

*Primary Examiner* — Rodney Bonnette
(74) *Attorney, Agent, or Firm* — Fitzpatrick, Cella, Harper & Scinto

(57) ABSTRACT

A cleaning unit configured to clean toner left on an image bearing unit includes a cleaning member configured to remove the toner, a coil spring conveying the toner removed by the cleaning member in a longitudinal direction of the cleaning member, and a support member being rotatable and supporting one end of the coil spring to transmit a rotational driving force to the coil spring. The support member is provided with a long hole lengthy in the longitudinal direction of the coil spring such that one end of the coil spring engages with the long hole.

11 Claims, 7 Drawing Sheets

CLEANING UNIT AND IMAGE FORMING APPARATUS

BACKGROUND OF THE INVENTION

Field of the Invention

The present invention relates to a cleaning unit, to an image bearing unit including the cleaning unit, and to an image forming apparatus including the cleaning unit.

Description of the Related Art

An electro-photographic image forming apparatus is configured to form an image by transferring a toner image formed on an image bearing unit such as a photosensitive drum, intermediate transfer body etc., onto a recording medium such as a sheet of paper, plastic etc.

Conventionally, the image forming apparatus such as one disposed in Japanese Patent Application Laid-open No. 2006-139084 (see FIG. 8 thereof) for example is configured to remove unused toner left on the image bearing unit by a cleaning blade 525 and to recover the toner within a drum cartridge 600. The recovered toner is conveyed by a toner conveying member installed near the cleaning blade 525 to a waste toner container (recovered toner box) outside of the drum cartridge from an aspect of prolonging a life of the process cartridge.

As a toner conveyer member, there is a case of adopting a toner conveying screw formed into a cylindrical (spring) shape by spirally winding a metallic wire rod (for instance, a screw 622 in Japanese Patent Application Laid-open No. 2006-139084). This toner conveying screw is disposed within a cylindrical toner conveying path and is rotationally driven by a driving system, e.g., a screw gear 526 in the abovementioned disclosure. As for the rotational driving force of the toner conveying member of this sort, there is a case of transmitting a rotational driving force from a driving system rotationally driving a photosensitive drum within a drum cartridge through a drum gear, besides using an independent driving source.

Although there is also known a screw type toner conveying member in which a blade is molded spirally around a center shaft (metallic or resin-made), the screw formed into the cylindrical shape by the spring as described above has advantages over the conventional one in that it enables to downsize, lighten, simplify, and lower the cost of the toner conveyer unit.

In connecting the driving system (screw gear) with the cylindrical (spring) screw, i.e., the toner conveying member, to transmit the driving force to the toner conveying member, there is a case of using a support structure of axially supporting the toner conveying member by tensioning from both ends of the toner conveying member, similarly to the case of the screw having the center shaft.

However, conventionally, a structure of connecting the driving system (screw gear) rigidly and integrally with the toner conveying screw even if the toner conveying screw is formed of the cylindrical (spring) screw is often adopted. Then, if the cylindrical (spring) screw generates vibration in such conventional structure, the vibration is transmitted to the driving system (screw gear).

Here, a possible factor of the vibration of the toner conveying screw is a reaction force received by the screw when the screw conveys recovered toner within a drum cartridge. This reaction force can be decomposed into a force mainly in a toner conveying direction (expansion direction) and a force in a screw rotating direction (twist direction).

If the screw vibrates due to the reaction force and the vibration is transmitted to the image bearing unit, it is not preferable because the image bearing unit may vibrate. Accordingly, a configuration that can reduce vibration energy transmitted from the screw to the image bearing unit is required.

SUMMARY OF THE INVENTION

The present disclosure provides a cleaning unit configured to reduce vibration of the spring screw. One feature of the present invention is the cleaning unit configured to clean toner left on an image bearing unit including a cleaning member configured to remove the toner, a coil spring conveying the toner removed by the cleaning member in a longitudinal direction of the cleaning member, and a support member being rotatable and supporting one end of the coil spring to transmit a rotational driving force to the coil spring. The support member is provided with a long hole lengthy in the longitudinal direction of the coil spring such that one end of the coil spring engages with the long hole.

Further features of the present invention will become apparent from the following description of exemplary embodiments with reference to the attached drawings.

DESCRIPTION OF THE EMBODIMENTS

An embodiment for carrying out the present disclosure will be described below with reference to the appended drawings. It is noted that the embodiment described below is one exemplary embodiment of the present disclosure to the end, and a person skilled in the art may appropriately modify detailed configurations for example within a scope not departing from a gist of the present disclosure. Still further, numerical values adopted in the embodiment are referential numerical values and do not limit the present disclosure. It is also construed that sizes, materials, forms, relative dispositions of components described below are also appropriately modified depending on a configuration and on various conditions of an apparatus to which the present disclosure is applicable, and the scope of the present disclosure is not limited only to those configurations unless specifically described.

Embodiment

Overall Structure of Image Forming Apparatus

Figure 1:
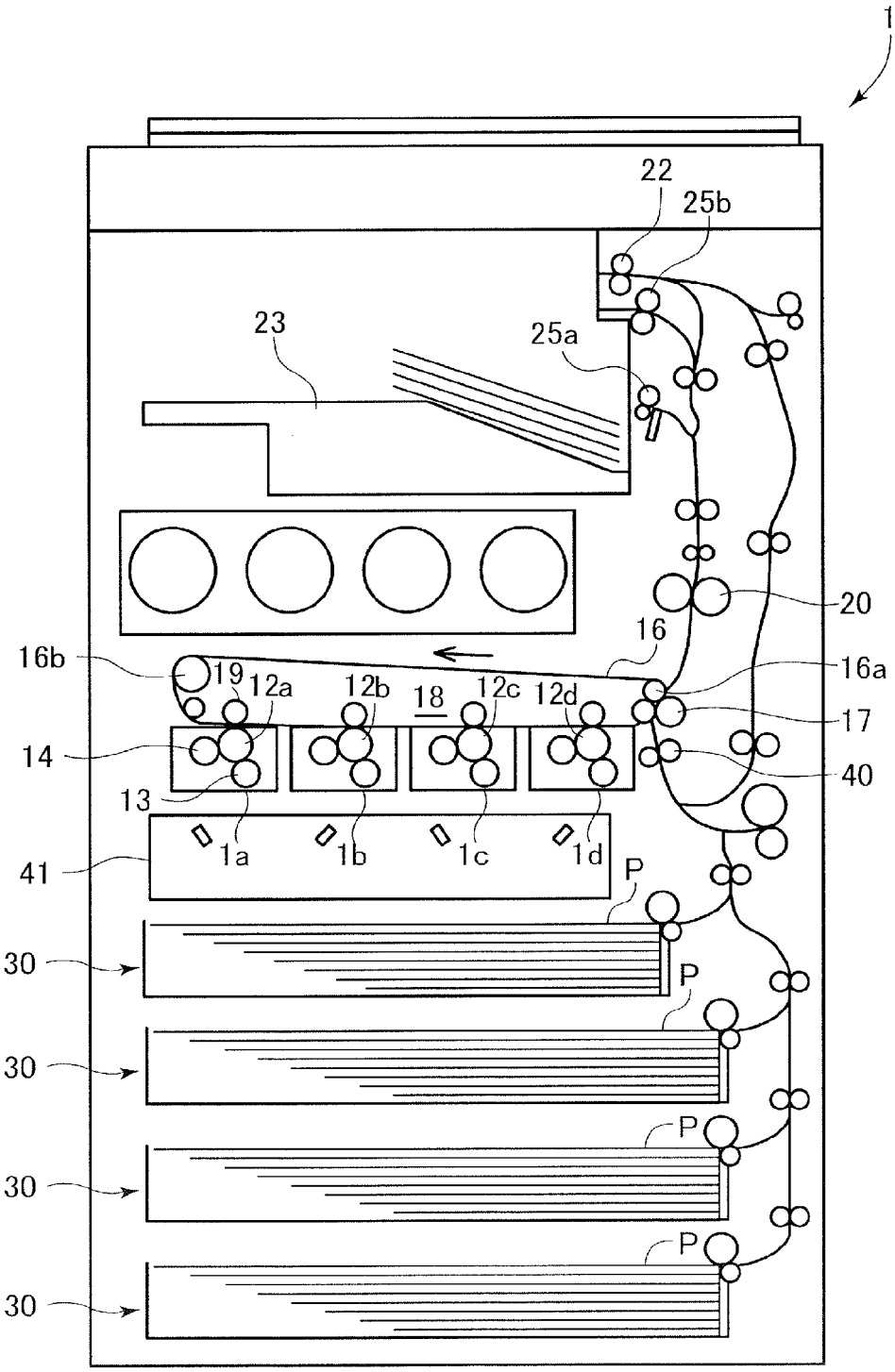
FIG. 1 is a section view schematically illustrating a structure of an electro-photographic image forming apparatus.

FIG. 1 illustrates one example of an entire configuration of an image forming apparatus 1 capable of carrying out the present disclosure. The image forming apparatus 1 in FIG. 1 includes image bearing units (electro-photographic photosensitive bodies) forming respective color toner images of yellow, magenta, cyan and black and is configured to record a color image on a recording medium such as a sheet of paper and a film. The image forming apparatus 1 includes four photosensitive drums 12*a* (yellow), 12*b* (magenta), 12*c* (cyan) and 12*d* (black) disposed in parallel with each other. An intermediate transfer belt 16, i.e., an intermediate transfer body, is disposed above the photosensitive drums 12*a* through 12*d* in a manner orthogonally crossing the respective photosensitive drums.

Disposed around each photosensitive drum (12*a* through 12*d*) driven by a motor (not illustrated) are a primary charger 13, a developing device 14 and others. The photosensitive drum (12*a* through 12*d*) and the primary charger 13, the developing device 14 and others can be unitized as a process cartridge (1*a*, 1*b*, 1*c*, and 1*d*) attachable/detachable to/from the image forming apparatus 1. An exposure unit 41 composed of polygonal mirrors and others is disposed under the photosensitive drums 12*a* through 12*d*. It is noted that in FIG. 1, although reference numerals of the primary charger 13, the developing device 14 and a transfer charging roller 19 described later are denoted only to those of the process cartridge 1*a* in order to avoid complications, those devices are provided in the same manner also in the process cartridges 1*b*, 1*c*, and 1*d* (only their shapes are illustrated).

At first, a laser beam composed of an image signal of yellow component color is projected to the photosensitive drum 12*a* in a first image forming portion through the polygon mirror and others of the exposure unit 41 to form an electrostatic latent image on the photosensitive drum 12*a*. Yellow toner is supplied to the electrostatic latent from the developing device 14 to visualize the electrostatic latent as a yellow toner image.

Along with a rotation of the photosensitive drum 12*a*, the toner image arrives at a primary transfer position where the photosensitive drum 12*a* comes into contact with an intermediate transfer belt 16. The yellow toner image on the photosensitive drum 12*a* is transferred onto the intermediate transfer belt 16 by a primary transfer bias applied to a transfer charging roller 19 at the primary transfer position (primary transfer step).

When a region of the intermediate transfer belt 16 carrying the yellow toner image moves to a next image forming portion, a magenta toner image which has been formed onto the photosensitive drum 12*b* by this time as described above. Then, the magenta toner image is superimposed and transferred by the transfer charging roller 19 onto the yellow toner image on the intermediate transfer belt 16 at a primary transfer position where the intermediate transfer belt 16 comes into contact with the photosensitive drum 12*b*. Then, as the intermediate transfer belt 16 moves along, a cyan toner image and subsequently a black toner image are sequentially superimposed and transferred onto the yellow and magenta toner images at primary transfer positions of the respective image forming portions.

Meanwhile, a recording medium P is stored in a cassette 30. The recording medium P is delivered one by one from the cassette 30 by a pick-up roller, is adjusted in its timing by a registration roller 40, and then arrives at a secondary transfer position. The four-color toner image on the intermediate transfer belt 16 is transferred collectively onto the recording medium P by a secondary transfer bias applied to the secondary transfer roller pair 17, i.e., a transfer portion, at the secondary transfer position (secondary transfer step).

The recording medium P onto which the four color toner image has been transferred is conveyed to a fixing roller pair 20, i.e., a fixing device, disposed above the secondary transfer roller pair 17 by being guided by a conveyer guide. The four-color toner image on the recording medium P is fixed by receiving heat and pressure through the fixing roller pair 20. Thus, the respective color toners melt, are blended, and are fixed as a full-color print image on the recording medium P. Then, by being guided by a conveyer guide, the recording medium P on which the toner image has been fixed is discharged onto a discharge tray 23 by discharge roller pairs 25*a* and 25*b*, i.e., a discharge portion, provided downstream of the fixing roller pair 20.

In a case of one-sided mode of forming an image only on one surface of the recording medium P, the recording medium P on which the image has been formed on one surface thereof is discharged onto the discharge tray 23 by the discharge roller pairs 25*a* and 25*b* as described above. Meanwhile, in a case of a duplex mode of forming images on both surfaces of the recording medium P, the recording medium P on which the image has been formed on one surface as described above is conveyed to a registration roller pair 22 in a state in which front and back surfaces thereof are reversed by passing through a duplex pass not illustrated. After that, an image is formed on the back surface of the recording medium P through a step similar to that of forming the image on the front surface. The recording medium P on which the images are formed on the front and back surfaces thereof is discharged onto the discharge tray 23 by the discharge roller pairs 25*a* and 25*b*.

A life of a transfer belt unit 18 in which the process cartridges 1*a* through 1*d*, the rollers 16*a* and 16*b* driving the intermediate transfer belt 16, the transfer charging roller 19 and others are unitized is short, by its very nature, as compared to the entire image forming apparatus 1. Therefore, the process cartridges 1*a* through 1*d* and the transfer belt unit 18 are configured to be replaceable during when the image forming apparatus 1 completes its entire life. It is possible to improve maintainability by unitizing the both process cartridges 1*a* through 1*d* and the transfer belt unit 18 and making them attachable/detachable.

Then, lately, there are electro-photographic image developing systems of single component toner and dual component toner developing systems. Along with the colorization, a dual component developer which is separated into toner and carrier is widely used from an aspect of a color developing nature. Meanwhile, in terms of a developing device of black color, the developing system is used separately depending on its use such that the single component developing system is used in a case where the device is required to be downsized and its space to be saved, while the dual component developing system is used in a case of a high-speed device. Still further, although a percentage between mono-chrome images and color images to be formed is gradually shifting to color images in the market, a number of mono-chrome images to be printed by an image forming apparatus are overwhelmingly greater than that of color images even though the image forming apparatus is configured to print mono-chrome and color images. Accordingly, durability of the black developer is desired to be longer than that of color developers.

On the other hand, a color image requires more faithful rendering performance, and an image forming apparatus forming images in a level of picture image quality is being developed. Accordingly, the size of toner particle to be used in such case is desirable to be as small as possible and a diameter thereof to be uniform. The market also demands to prolong a service life of periodic replacement components required to cut a running cost to suppress a maintenance cost. Lately, some developing device adopts an ACR (auto-carrier refreshing) system or downsizes a developing sleeve of the developing device to suppress deterioration and to prolong a life of the developer. Then, a color developing device capable of printing images equivalent to about a half million A4 size sheets is available in the market.

Drum Cartridge

In the present embodiment, the toner conveyer unit includes a toner conveying screw as a toner conveying member configured to discharge unused toner collected by cleaning toner remaining on the image bearing unit (photosensitive drum), to carry an electro-photographically formed toner image.

This toner conveyer unit is disposed together with a cartridge, e.g., the process cartridges 1*a* through 1*d*, containing the image bearing unit (photosensitive drum). Several different configurations are conceivable for the 'cartridge' as such an image bearing unit. For instance, there is known a configuration of a process cartridge storing the developing device 14 described above, the photosensitive drum 12, the cleaning blade 320*a*, a primary charger 13 and a waste toner container not illustrated within one cartridge. There is also known a separate type in which only the developing device part is separated as a separate unit and the photosensitive drum, the primary charger, the cleaning blade, the toner conveyer unit and others are unitized as a drum cartridge.

Regardless of such cartridge configurations, the toner conveyer unit of the present disclosure can be carried out as a unit conveying the recovered toner generated in cleaning the photosensitive drum. The following description will be made by exemplifying a configuration of using a separate type process cartridge especially on exemplary configurations of the toner conveyer unit disposed around the drum cartridge as the image bearing unit.

Figure 2:
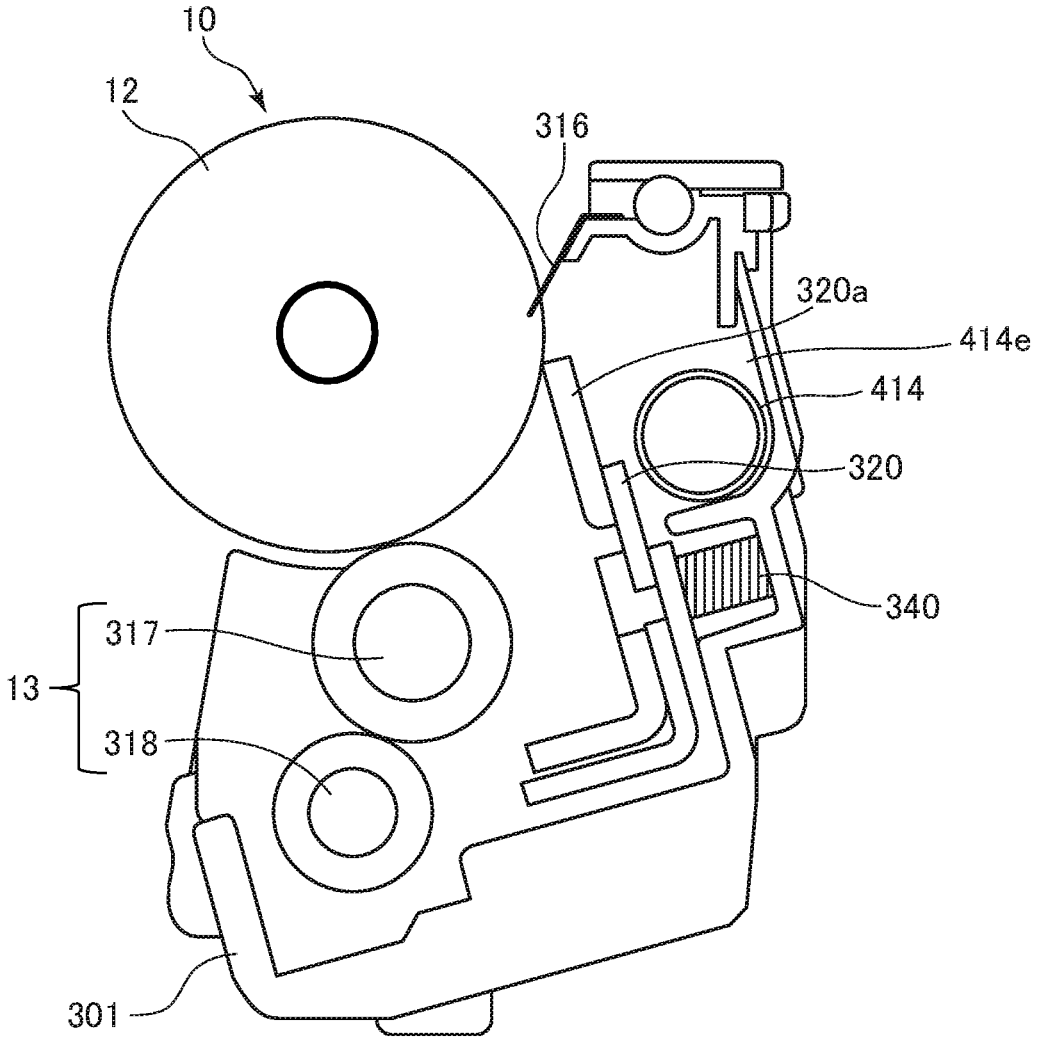
FIG. 2 is section view illustrating a main part of a drum cartridge employed in the image forming apparatus in FIG. 1.

In the case of the configuration of the separate cartridge, a region of the photosensitive drum (12*a* through 12*d*) of the process cartridges 1*a* through 1*d* illustrated in FIG. 1 can be unitized as a drum cartridge 10 as illustrated in FIG. 2 for example.

FIG. 2 illustrates a sectional structure of a main part of the drum cartridge 10. The drum cartridge 10 in FIG. 2 includes the photosensitive drum 12 (12*a* through 12*d* in FIG. 1) within a drum frame 301 (casing). A cleaning blade 320*a*, the primary charger 13, a scoop sheet 316 and others are disposed around the photosensitive drum 12 within the drum frame 301.

While the photosensitive drum 12 around 30 mm in diameter is often used in general, the cleaning blade 320*a* made of a plate-like urethane material for example is urged so as to come into with the photosensitive drum 12 to scrape the residual toner on the surface of the photosensitive drum 12 in the drum cartridge 10. In the configuration in FIG. 2, the cleaning blade 320*a* is attached to a frame 320 and is configured such that a tip of the cleaning blade 320*a* comes into contact with the photosensitive drum 12 by being urged by an urging device 340 such as a spring configured to urge the frame 320.

The unused toner on the surface of the photosensitive drum 12 scraped by the cleaning blade 320*a* is conveyed to a waste toner container not illustrated by a toner conveying screw 414 disposed in parallel with the photosensitive drum 12 from an aspect of prolonging a life of the process cartridge. The toner conveying screw 414 is composed of a wire rod formed into a cylindrical spring as described later. The toner conveying screw 414 conveys the toner by being rotationally driven within a toner conveying path 414*e* through a driving system transmitting a driving force of the photosensitive drum 12 in the present embodiment.

It is noted that in the drum cartridge 10 in FIG. 2, the scoop sheet 316 is disposed in a vicinity of the cleaning blade 320*a* to prevent the toner from scattering within the apparatus. Further in the drum cartridge 10 in FIG. 2, the primary charger 13 is composed of a primary charging roller 317 and a cleaning roller 318.

Figure 3:
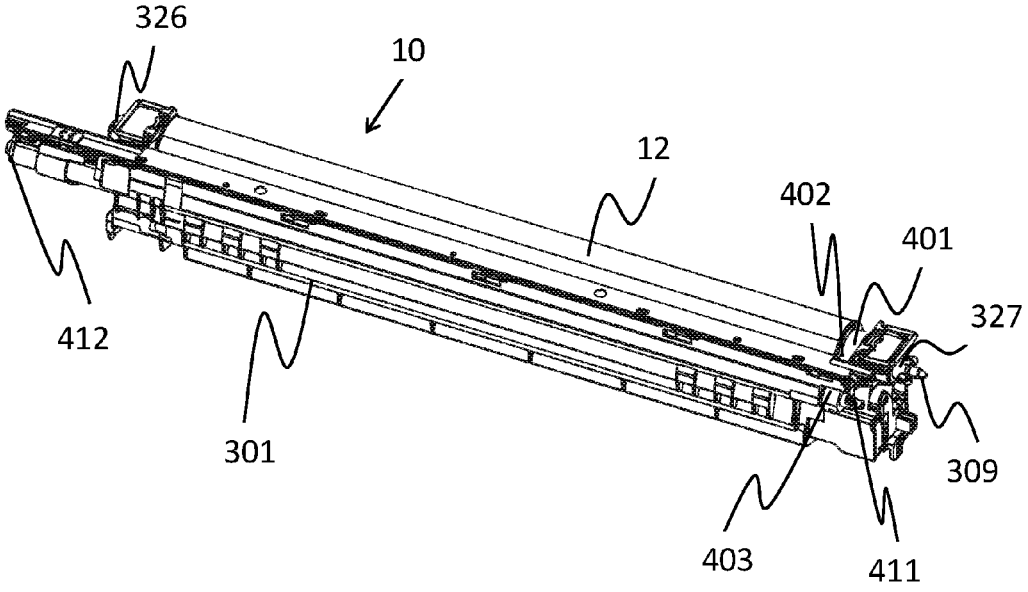
FIG. 3 is a perspective view illustrating an appearance of the drum cartridge employed in the image forming apparatus in FIG. 1.

The structure of the drum cartridge 10 of the present embodiment will be described in detail below with reference to FIGS. 3 through 6. FIG. 3 illustrates an appearance of the drum cartridge 10. As illustrated in FIG. 3, the drum frame 301 is provided with through-holes at positions agreeing with a center shaft of the drum to dispose bearing portions 326 and 327 such as bearings and sintered bearings. A drum shaft 309 is inserted through the bearing portions 326 and 327. This arrangement makes it possible to axially support and to rotationally driven the photosensitive drum 12 in high precision. Still further, the drum shaft 309 is in contact with an inner surface of the drum through a contact point not illustrated and provided within the photosensitive drum 12 to be electrically conductive and to be connected with the earth.

Figure 4:
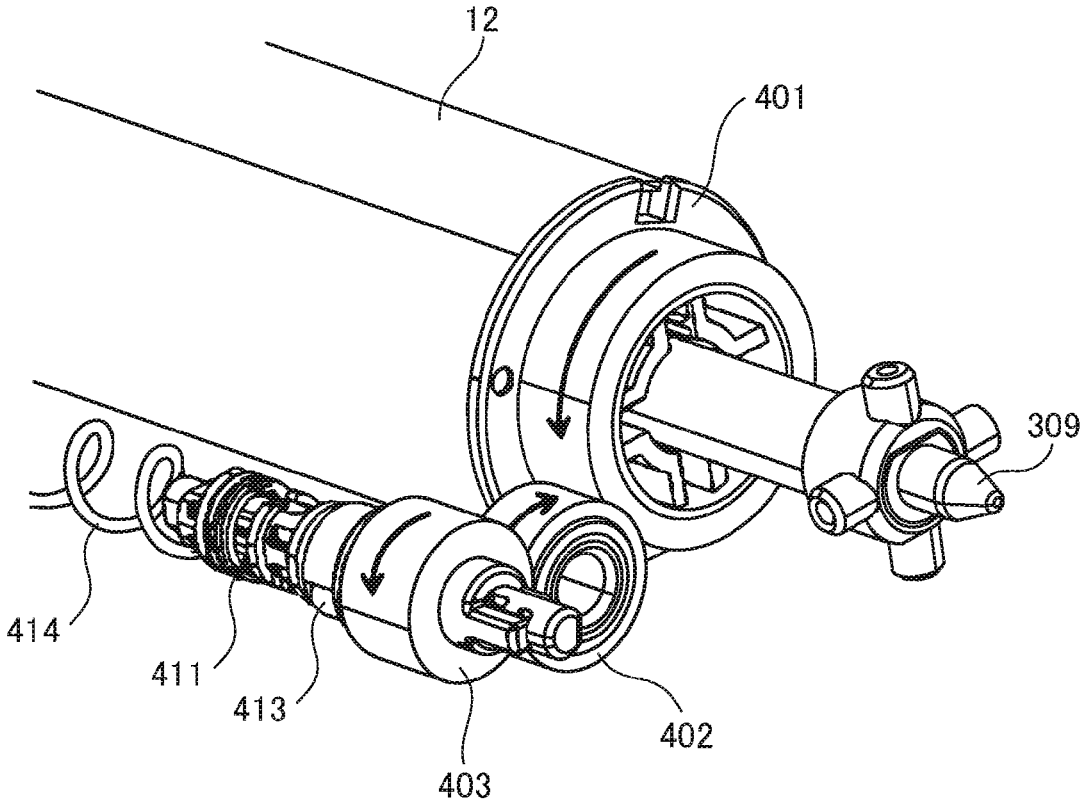
FIG. 4 is a perspective view illustrating a driving system of the drum cartridge illustrated in FIGS. 2 and 3.

As illustrated in FIG. 4, disposed at an end of the photosensitive drum 12 is the driving system composed of a drum gear 401, an idler gear 402, and a screw gear 403 as a drive receiving portion transmitting the rotation of the photosensitive drum 12 (image bearing unit) to the toner conveying screw 414.

The photosensitive drum 12 is coupled integrally with the drum gear 401 in FIG. 4 by pressure-fitting, caulking and others. The rotational driving force transmitted from a driving source such as a motor disposed on the unit body side not illustrated to the drum shaft 309 is transmitted to the drum gear 401 and the photosensitive drum 12 through a parallel pin or the like not illustrated and provided integrally with the drum shaft 309. Meanwhile, the screw gear 403 is coupled integrally with a driving-side support member 411 composing a support member of one end side of the toner conveying screw 414. The driving-side support member 411 is supported by the drum frame 301 through a support member bearing 413. Still further, another end side of the toner conveying screw 414 is supported by a driven-side support member 412 (other end support member in FIG. 7), and a position of the other end of the toner conveying screw 414 having the cylindrical spring structure is restricted in a longitudinal direction (toner conveyance direction).

Along with an advance of an image forming process, the rotational driving force applied to the photosensitive drum 12 is transmitted to the driving-side support member 411 through the driving system composed of the drum gear 401, the idler gear 402 and the screw gear 403. Thus, the toner conveying screw 414 is rotationally driven. This arrangement makes it possible to advance the process of forming the image on the surface of the photosensitive drum 12 and to convey and recover the unused toner, scraped by the cleaning blade 320*a* (see FIG. 2), by the toner conveying screw 414 in the same time.

Figure 5:
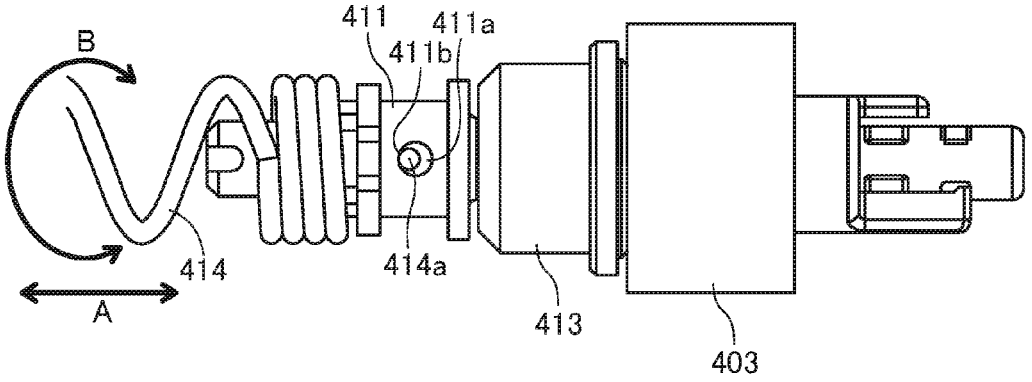
FIG. 5 illustrates an exemplary structure of the cleaning unit.

Here, a configuration as illustrated in FIGS. 5 and 6A through 6C are conceivable as exemplary structures for supporting the toner conveying screw 414. As illustrated in FIG. 5, a toner conveying screw 414 formed of a wire rod for a cylindrical spring includes a driving-side screw end 414*a*, i.e., a spring free end.

A driving-side support member 411 on a side of a screw gear 403 includes a long hole 411*a* in a longitudinal direction of the toner conveying screw 414. Conventionally, there is known a configuration of hooking the driving-side screw end 414*a*, i.e., the spring end, of the toner conveying screw 414 to a long hole one end 411*b*, in order to extend the toner conveying screw 414 to always apply a tension to the toner conveying screw 414 during an entire driving period. Thus, in this tensioned-spring configuration, the toner conveying screw 414 is connected rigidly and integrally with the screw gear 403 specifically in terms of the longitudinal direction (toner conveyed direction).

For instance, the conventional structure assumes a longitudinal dimensional tolerance of the driving-side screw end 414*a* of the toner conveying screw 414 of ±1.0 mm and a spring maximum expansion amount in conveying toner of around 0.2 mm. Then, an entire length of the toner conveying screw 414 to the driving-side screw end 414*a* is set to be shorter than the position of the long hole one end 411*b* by around 2 mm. This arrangement makes it possible to always apply the tension to the toner conveying screw 414 during the entire driving period especially in the longitudinal direction (toner conveying direction) even if the tolerance of the toner conveying screw 414 is minimum and to connect the toner conveying screw 414 almost rigidly and integrally with the screw gear 403.

However, if the tension is always applied to the toner conveying screw 414 especially in the longitudinal direction (toner conveyer direction) and the toner conveying screw 414 is almost rigidly and integrally connected with the screw gear 403 as in the conventional structure, the abovementioned vibration problem would be raised. That is, there is a possibility that the vibration energy having the components in the expansion (or contraction) direction A and the twist direction B of the toner conveying screw 414 is transmitted to the screw gear 403. Then, there is also a possibility that the vibration transmitted from the toner conveying screw 414 to the screw gear 403, i.e., a drive transmitting portion, causes rotational fluctuation of the drum gear 401, i.e., rotational fluctuation of the surface of the photosensitive drum 12. This fluctuation may cause an image forming failure such as pitch irregularity as described above. Here, a reaction force containing the respective components in the toner conveying direction (expansion direction A) and in the screw rotating direction (twist direction B) may be cited as a factor of vibrating the toner conveying screw 414 of the toner conveyer unit.

Figure 6A:
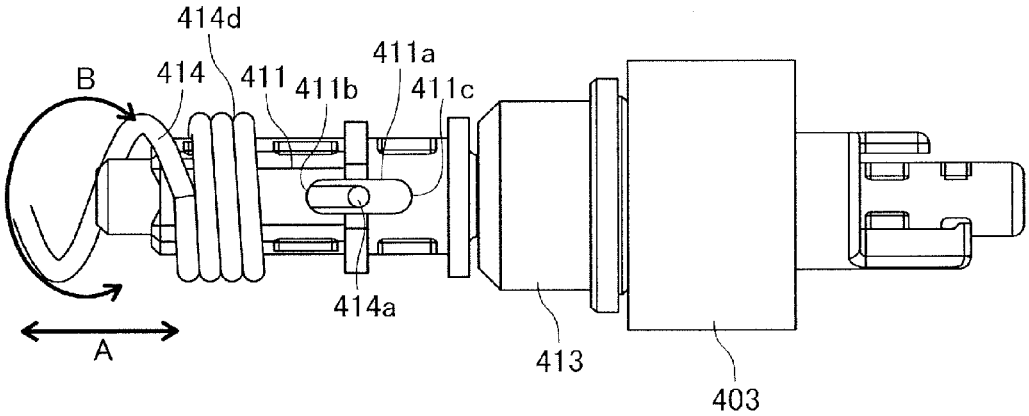
FIG. 6A illustrates a state in which a toner conveying screw is located at a reference position in a driving-side support member supporting one end of the toner conveying screw of the cleaning unit in which the present disclosure is adopted.
Figure 6B:
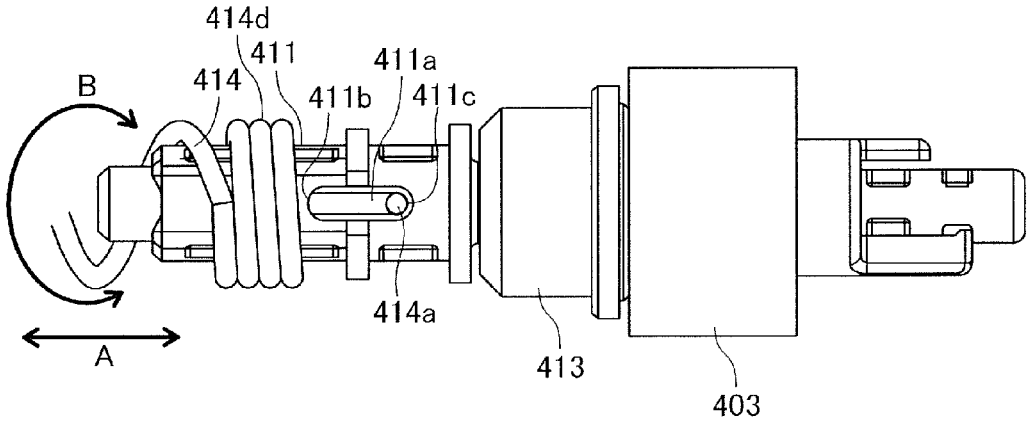
FIG. 6B illustrates a state in which the toner conveying screw is elongated in the driving-side support member supporting one end of the toner conveying screw of the cleaning unit in which the present disclosure is adopted.
Figure 6C:
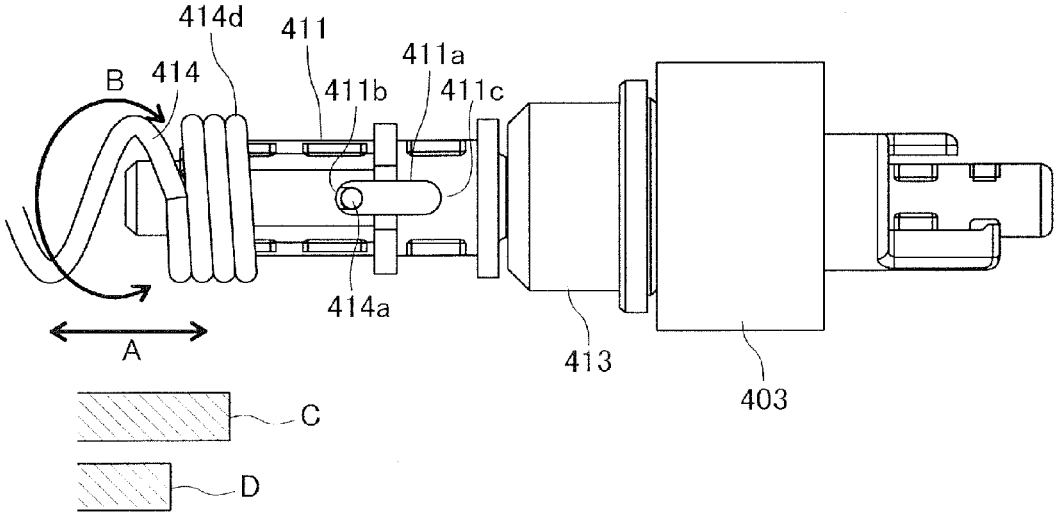
FIG. 6C illustrates a state in which a toner conveying screw is contracted in the driving-side support member supporting one end of the toner conveying screw of the cleaning unit in which the present disclosure is adopted.

Then, according to the present embodiment, the support member supporting one end of the toner conveying screw 414 is constructed so as to support the driving-side screw end 414*a*, i.e., one end of the toner conveying screw 414, movably in the longitudinal direction (toner conveying direction) as illustrated in FIGS. 6A through 6C. This support member is also constructed to transmit the rotational driving force in a rotational driving direction of the driving system (401 through 403) to the driving-side screw end 414*a*, i.e., one end of the toner conveying screw 414.

Specifically, the support member of the toner conveying screw 414 is constructed as illustrated in FIGS. 6A through 6C for example.

As illustrated in FIGS. 6A through 6C, the toner conveying screw 414 includes a center region where a winding pitch is relatively sparse and contributes to the conveyance of the toner and a positioning portion 414*d* where the winding pitch is relatively dense between the center region and the driving-side screw end 414*a*, i.e., the spring free end of the toner conveying screw 414. An inner diameter of the positioning portion 414*d* is larger than an outer diameter of the driving-side support member 411 with a slight margin, and the positioning portion 414*d* is slidable in the longitudinal direction (toner conveying direction) with respect to the driving-side support member 411. Still further, the entire toner conveying screw 414 is positioned coaxially with the driving-side support member 411 by the engagement of the positioning portion 414*d* and the driving-side support member 411.

A part continuing from the positioning portion 414*d* to the driving-side screw end 414*a*, i.e., the screw free end, of the toner conveying screw 414 is entered to the center part of the driving-side support member 411 from a through-hole on a back surface side of FIGS. 6A through 6C for example, and a tip thereof is bent to construct as the driving-side screw end 414*a*. Then, the driving-side screw end 414*a* is engaged within the long hole 411*a*.

As illustrated in FIG. 6A for example, the long hole 411*a* provided through the driving-side support member 411 composes an engage portion engaging with one end of the toner conveying screw 414 formed into the coil spring. Then, the long hole 411*a* is defined with a dimension movably supporting the toner conveying screw 414 specifically in the longitudinal direction (toner conveying direction). In the present embodiment, the driving-side screw end 414*a*, i.e., the spring free end, of the toner conveying screw 414 is engaged and supported between the one end 411*b* and the other end 411*c* of the long hole 411*a* during the entire driving period of the toner conveying screw 414.

For example, a longitudinal dimensional tolerance of the toner conveying screw 414 within the long hole 411*a* of the driving-side support member 411 is assumed to be ±1.0 mm, and a spring maximum expansion and contraction amount during the entire driving period in conveying toner is assumed to be around 0.2 mm. In this case, an entire length of the long hole 411*a* is selected such that a gap in the longitudinal direction of the toner conveying screw 414 becomes around 1.5 mm respectively on both sides of the driving-side screw end 414*a*. Accordingly, the entire length of the long hole 411*a* is preferable to be 3.0 mm or more.

FIG. 6A illustrates a state in which the toner conveying screw 414 is in a free length condition. The driving-side screw end 414*a* is located at the center of the long hole 411*a* of the driving-side support member 411, thus leaving gaps around 1.5 mm respectively to the both ends 411*b* and 411*c* of the long hole 411*a*.

Still further, FIGS. 6B and 6C illustrate states in which the toner conveying screw 414 expands/contracts in the longitudinal direction (toner conveying direction) corresponding to a condition of the reaction force and others from the toner being conveyed. FIG. 6B illustrates the state in which the toner conveying screw 414 expands to its tolerance maximum length. FIG. 6C illustrates the state in which the toner conveying screw 414 contracts to its tolerance minimum length.

The driving-side screw end 414*a*, i.e., the one end, of the toner conveying screw 414 will not always come into contact with the driving-side support member 411 especially in the longitudinal direction (toner conveying direction) by constructing the long hole 411*a* of the driving-side support member 411 with the abovementioned dimension and shape. That is, however the toner conveyance resistance varies, the tension-free state of the toner conveyer screw 414 is assured in the longitudinal direction (toner conveying direction) during the entire driving period of the toner conveying screw 414. Still further, as illustrated in FIG. 6C, if a toner conveyable area c of the toner conveying screw 414 is set so as to cover a wider range outside of an image forming area D of the photosensitive drum 12, the whole image forming area D of the photosensitive drum 12 can be covered by the toner conveyable area C, thus, the toner conveying performance is not swayed at the peripheral area of the toner conveying screw 414.

As described above, according to the present embodiment, one end support member 411 for the toner conveying screw 414 supports the driving-side screw end 414*a*, i.e., the one end, of the toner conveying screw 414, via the long hole 411*a*, movably in the longitudinal direction (toner conveying direction). Still further, the toner conveying screw 414 accepts the driving force of the driving system (401 through 403) in the rotational driving direction transmitted via the engagement of the long hole 411*a* and the driving-side screw end 414*a*, i.e., the one end. This configuration makes it possible to always free the tension between the toner conveying screw 414 and the screw gear 403 or the tension in the longitudinal direction of the toner conveying screw 414, i.e., the tension in the toner conveying direction (in the direction in parallel with the toner conveying direction) in particular. Therefore, the vibration energy in the expansion (or contraction) direction A of the toner conveying screw 414 is consumed because the driving-side screw end 414*a* is movable in the longitudinal direction of the long hole 411*a*. Even if vibrations having the respective components in the expansion direction A and the twist direction B is generated in the toner conveying screw 414, the entire vibration energy transmitted to the screw gear 403 is considerably reduced. Thus, this arrangement makes it possible to suppress an irregular pitched image, which might be otherwise caused by the rotational fluctuation of the drum gear 401.

Figure 7:
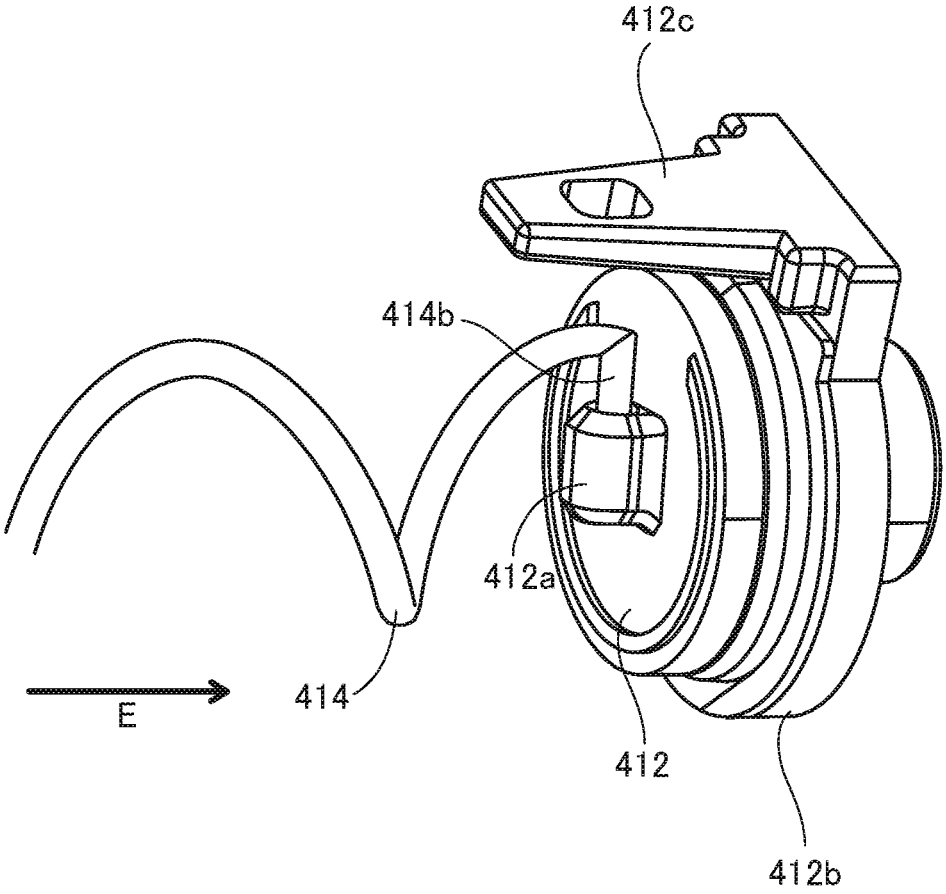
FIG. 7 illustrates a driven-side support member supporting another end of the toner conveying screw in the cleaning unit in which the present disclosure is adopted.

FIG. 7 illustrates a support structure of a driven side (left side in FIG. 3) of the other end of the toner conveying screw 414. In FIG. 7, the driven-side support member 412 disposed on a side opposite to the drive transmitting portion in the longitudinal direction of the toner conveying screw 414 includes a coupling portion 412*a* integrally connectable with a driven-side screw end 414*b* of the toner conveying screw 414. The driven-side support member 412 is approximately a cylindrical member and is rotatably supported by a support frame 412*b* of the driven-side support member 412. The support frame 412*b* is secured at a predetermined position of the drum frame 301 through screwing or the like through an attachment portion 412*c*. This arrangement makes it possible to position the other end (left side in FIG. 3) of the toner conveying screw 414 in the longitudinal direction with respect to the drum frame 301.

It is noted that the toner conveying direction of the toner conveying screw 414 is preferable to be in a direction E indicated in FIG. 7. Such arrangement makes it possible to urge the toner conveying screw 414 to the drum frame 301 through the driven-side support member 412 and to stably position the other end in the longitudinal direction when the toner conveying screw 414 receives the reaction force from the toner in carrying the toner.

As described above, the present embodiment adopts the configuration which frees the tension between the toner conveying screw 414 and the screw gear 403 or the tension in the longitudinal direction of the toner conveying screw 414, i.e., the tension in the toner conveying direction in particular. Therefore, it is possible to considerably reduce the vibration energy generated by the toner conveying screw 414 formed into the cylindrical coil spring and transmitted to the driving system (401 through 403) caused by the vibration having the respective components in the expansion direction and the twist direction. Due to that, it is possible to reduce the rotational fluctuation on the photosensitive drum 12 coupled through the driving system (401 through 403) and to suppress the image forming failure such as the irregular pitch image from being generated. Still further, the present embodiment can be carried out simply at low cost just by defining the long hole 411*a* through the driving-side support member 411 in accordance to specification, dimension and others of the toner conveying screw 414 and requires no additional component, so that the present embodiment can improve the image forming function simply at low cost.

The configuration of the present disclosure can be broadly carried out in the toner conveyer unit including the toner conveying member being rotationally driven to convey toner like the toner conveying screw, in a drum (process) cartridge using the toner conveyer unit, or the like. It is noted that in the present embodiment, while the toner conveying member has been exemplified by the toner conveying screw formed by the wire rod for the cylindrical coil spring, the present disclosure may be broadly carried out in a device using a toner conveying member conveying toner by being rotationally driven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-165594, filed Aug. 25, 2015, which is hereby incorporated by reference herein in its entirety.

What is claimed is:

1. A cleaning unit for removing toner on an image bearing unit, comprising:

a cleaning member configured to remove the toner;

a coil spring configured to convey the toner removed by the cleaning member in a longitudinal direction of the cleaning member;

a rotatable support member configured to support a first end of the coil spring to transmit a rotational driving force to the coil spring; and an engaging portion, provided in the support member, configured to engage with the first end of the coil spring, the coil spring being disposed such that the first end of the coil spring is disposed within the engaging portion at a position not in contact with both ends of the engaging portion in the longitudinal direction of the coil spring.

2. The cleaning unit according to claim 1, further comprising a support portion configured to support a second end of the coil spring such that the coil spring is rotatable.

3. The cleaning unit according to claim 1, further comprising a drive receiving portion configured to receive the driving force for rotating the support member from the image bearing unit.

4. The cleaning unit according to claim 1, wherein a length of the portion in the longitudinal direction of the coil spring is 3.0 mm or more.

5. A cleaning unit for removing toner on an image bearing device unit, comprising:

a cleaning member configured to remove the toner;

a coil spring configured to convey the toner removed by the cleaning member in a longitudinal direction of the cleaning member;

a rotatable support member configured to support a first end of the coil spring to transmit a rotational driving force to the coil spring; and an engaging portion, provided in the support member, configured to engage with the first end of the coil spring, a length of the engaging portion in the longitudinal direction of the coil spring being 3.0 mm or more.

6. The cleaning unit according to claim 5, further comprising a supporting portion configured to support a second end of the coil spring such that the coil spring is rotatable.

7. The cleaning unit according to claim 5, further comprising a drive receiving portion configured to receive the driving force for rotating the support member from the image bearing unit.

8. A cleaning unit for removing toner on an image bearing unit, comprising:

a cleaning member configured to remove the toner;

a coil spring configured to convey the toner removed by the cleaning member in a longitudinal direction of the cleaning member;

a rotatable support member configured to support a first end portion of the coil spring to transmit a rotational driving force to the coil spring;

an engaging portion, provided in the rotatable support member, configured to engage with the first end portion of the coil spring such that the first end portion of the coil spring is movable to the rotatable support member along the longitudinal direction of the coil spring, a length of the engaging portion in the longitudinal direction of the coil spring being determined such that a force is not applied from the first end portion of the coil spring to the rotatable support member in the longitudinal direction of the coil spring, while the first end portion of the coil spring is rotating; and a support portion configured to support a second end portion of the coil spring such that the coil spring is rotatable, and a position of the second end portion is regulated in the longitudinal direction of the coil spring.

9. The cleaning unit according to claim 8, further comprising a drive receiving portion configured to receive a driving force for rotating the support member from the image bearing unit.

10. The cleaning unit according to claim 8, wherein the length of the engaging portion in the longitudinal direction of the coil spring is 3.0 mm or more.

11. The cleaning unit according to claim 8, wherein the length of the engaging portion in the longitudinal direction of the coil spring is greater than the movement of the first end portion of the coil spring in the longitudinal direction of the coil spring while the coil spring is rotating.

* * * * *